US005964542A

United States Patent [19]

Ruhe et al.

[11] Patent Number: 5,964,542

[45] Date of Patent: Oct. 12, 1999

[54] CARRIAGE SYSTEM WITH VARIABLE BELT TENSION

[75] Inventors: Thomas W. Ruhe, LaCenter; Jason Quintana, Vancouver; Geoff Wotton, Battleground, all of Wash.

[73] Assignee: Hewlett-Packard Company, Palo Alto, Calif.

[21] Appl. No.: 09/089,925

[22] Filed: Jun. 3, 1998

[51] Int. Cl.[6] ..... B41J 11/22

[52] U.S. Cl. ..... 400/352; 400/328; 400/335; 400/162.1

[58] Field of Search ..... 400/328, 352, 400/354.1, 354.3, 323, 326, 335, 162.1

[56] References Cited

U.S. PATENT DOCUMENTS

| | | | |
|---|---|---|---|
| 3,908,809 | 9/1975 | Beattie | 197/18 |
| 4,084,681 | 4/1978 | Heinzl et al. | 197/82 |
| 4,479,731 | 10/1984 | Kawaguchi | 400/320 |
| 5,098,209 | 3/1992 | Gomoll et al. | 400/320 |
| 5,415,483 | 5/1995 | Franklin, Jr. | 400/328 |
| 5,779,376 | 7/1998 | Seu | 400/335 |

*Primary Examiner*—Ren Yan
*Assistant Examiner*—Dave A. Ghatt

[57] ABSTRACT

A carriage drive system includes a timing belt pivotally anchored to a carriage. A drive motor rotates the timing belt, moving the carriage along a carriage path. The drive belt moves along a pair of pulleys. A first pulley is coupled to the motor's drive shaft. A second pulley is coupled to an idler spring. The idler spring determines the belt tension when the belt is stationary. Acceleration of the carriage alters the belt tension. A pivot connection occurs between the drive belt and the carriage. During acceleration, the pivotal connection rotates shortening the effective length of the belt, which in turn stretches the idler spring, and increases belt tension. While the carriage is at rest or moving at constant velocity, the pivot connection serves to reduce side load impact on the drive motor's shaft and windings. The pivot connection also isolates the carriage from high frequency vibrations.

15 Claims, 6 Drawing Sheets

FIG. 1
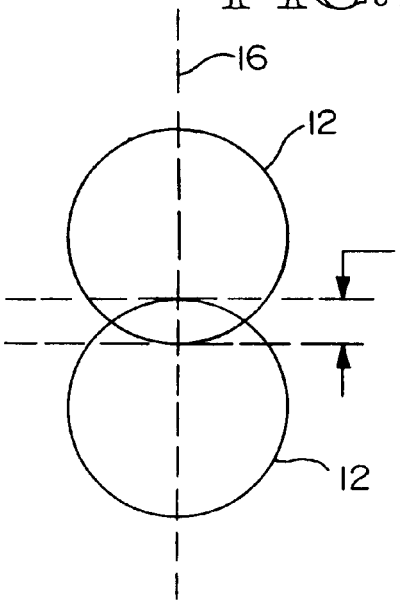
FIG. 2
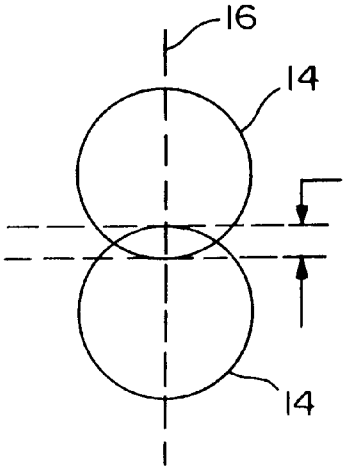
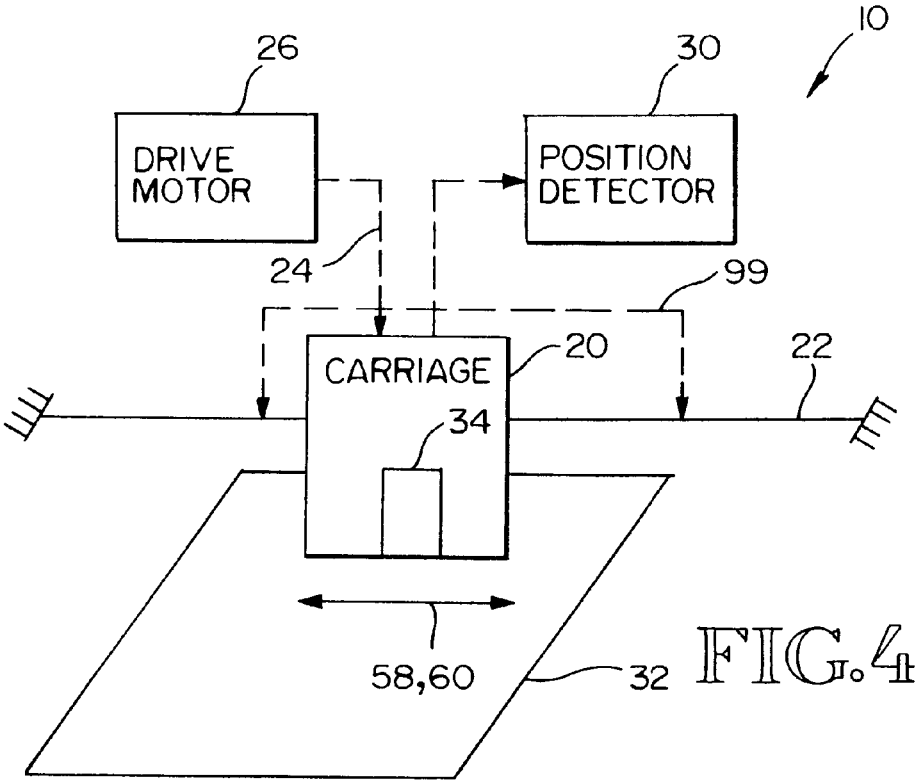
FIG. 4

CARRIAGE SYSTEM WITH VARIABLE BELT TENSION

BACKGROUND OF THE INVENTION

This invention relates generally to carriage drive systems for printing and scanning devices, and more particularly, to an apparatus and method for varying belt tension in a carriage scanning system.

In inkjet printing systems and document scanning systems a carriage is moved relative to a media to either print or scan the media. In an inkjet printing system, the carriage carries an inkjet pen which ejects ink drops onto the media as the media is moved along a media path. In a document scanning system the carriage carries an optical sensor which detects ink markings or characters on the media as the carriage moves relative to the media. Conventionally, the carriage is driven back and forth by a timing belt. The timing belt is driven by a pulley on a motor shaft, and is kept in tension by an idler spring. The maximum acceleration of the carriage in a timing belt system is a function of belt tension and carriage mass. Beyond the maximum acceleration the stability of the carriage decreases. The belt tension is controlled by the idler spring. For large carriages or higher acceleration rates, the desired belt tension for accurate control is larger than for smaller carriages and lower acceleration rates. If the belt tension is raised, however, the load on the drive motor increases, which in turn can shorten the useful life of the motor. Accordingly, there is a need for a drive belt system which can operate at increasing acceleration or carry larger masses without shortening the useful life of a given drive motor.

To achieve accurate printing or scanning, it is important to know or maintain an accurate positional relationship between the carriage and the media. In inkjet printing it is important that the carriage scan the inkjet pen smoothly across the media with minimum vibration so that ink dots can be accurately placed. Conventional inkjet printers print 300 dots per inch or 600 dots per inch. In addition, printers which print at 1200 dots per inch are being sought. As the number of dots per inch increases, the dot size has decreased. Precise dot positioning of the smaller dots at increasing dot density leads to higher quality images. In particular, such positioning of colored dots is leading to near photographic image quality. One challenge in striving to achieve such improved image quality is the adverse impact of carriage vibrations. FIG. 1 shows two overlapping circles 12 of a common size. Each circle 12 represents an inkjet printing dot of a first size. Such size is largely exaggerated here for purposes of illustration. FIG. 2 shows two overlapping circles 14 having a common second size which is smaller than the first size. Again, each circle 14 represents an inkjet printing dot of a second size, and such size is largely exaggerated for purposes of illustration. In each example, the dots 12 and dots 14 overlap by a common percentage of their respective diameters (e.g., 20%). The absolute distance of overlap is larger for the larger dots 12 than for the dots 14. The overlap of dots 12 is a distance x. The overlap of dots 14 is a distance y. For purposes of illustration, assume that dots 14 are half the size of dots 12 and that y=0.5x.

Consider now a situation where the carriage vibrates during printing along an axis 16. If the vibration amplitude along axis 16 is much smaller than the distance x, then the impact of the vibration will not adversely impact the dot placement accuracy, and thus will not adversely impact the image quality. As the vibration amplitude along axis 16 approaches the distance x, however, more white space occurs on the media in the vicinity of the dots 12 intersection. Taken over an entire image, the effect appears as a banding of lighter and darker areas of the image. FIG. 3 shows an exemplary image 18 exhibiting such banding.

Given the same amount of vibration amplitude, the impact to an image formed of the smaller dots 14 is more adverse than to an image formed with the dots 12. For example, a vibration amplitude of 0.25x may be acceptable for printing using dots 12. The same vibration amplitude equals 0.5y and may cause unacceptable banding when printing with the dots 14. Such bands occur within an image at the frequency of vibration of the carriage along the axis 16. In general, the smaller dot size and higher resolution of advancing ink jet printers require more accurate placement of dots to achieve expected image quality improvements.

Any vibrations displacing the carriage relative to the media can potentially reduce printing/scanning accuracy. Typical sources of vibration are external vibrations which move the whole printer or scanner, and internal sources which are coupled to the carriage or media. This invention is directed toward internal vibrations which are coupled to the carriage.

SUMMARY OF THE INVENTION

According to the invention, a carriage drive system includes a timing belt pivotally anchored to a carriage. A drive motor rotates the timing belt, moving the carriage back and forth along a carriage path. The drive belt moves on a pair of pulleys. A first pulley is coupled to a shaft of the drive motor. A second pulley is coupled to an idler spring. The idler spring determines the belt tension when the belt is stationary. Acceleration of the carriage alters the belt tension. According to this invention a pivot connection occurs between the drive belt and the carriage.

According to one aspect of the invention, the pivotal connection allows for a lower belt tension during steady state operations (e.g., zero velocity, constant velocity). Rather than maintain the belt at a high tension during rest and steady state periods, the tension is reduced during such periods. One benefit of the reduction is a decrease in side load to the shaft of the drive motor.

During accelerated motion, the motor increases the velocity of the timing belt. Such acceleration causes the pivotal connection to rotate. This shortens the effective length of the belt, which in turn increases the force on the idler spring, thereby increasing the belt tension. Along with the increased belt tension is an increase in side load upon the drive shaft. Thus, large side loads are incurred on the drive shaft only during accelerated motion of the carriage. Once steady state velocity is achieved, the belt tension decreases and the pivotal connection rotates back, decreasing the side load impact on the drive shaft.

An advantage of the pivotal connection is that belt tension is increased only when needed. During stewing the belt tension is low. During acceleration the belt tension is increased. Another advantage is that large side loads only occur during acceleration. Larger side loads increase friction on the motor bearings, which in turn decreases the motor's thermal margin. Because the larger side loads do not occur during rest and steady state operation, the motor bearings wear longer. Increased side loads also exert a bending moment on the shaft that can fatigue the motor windings and solders joints. The decrease in side load during rest and steady state operation results in smaller bending moment. Thus, the life of the motor windings and solder joints are prolonged.

According to another aspect of this invention, high frequency vibrations in the drive belt are decoupled from the carriage by the pivotal connection. All forces exerted on the carriage through the drive belt are passed through the pivot connection. Such pivot connection serves, in effect, as a low pass filter of vibration frequency components occurring in the plane of the pivot motion (e.g., vibrations in the timing belt). Vibration frequencies above a prescribed frequency determined by the pivot connection are absorbed, and thus, are filtered out. Vibrations below such frequency pass to the carriage.

The spring characteristics of the pivot connection are prescribed so as to isolate the carriage from high frequency ripples in belt tension, such as those caused from motor commutation, stepping or cogging. This allows for smoother carriage motion and less carriage lift-off, chatter and procession. As a result, print quality is improved for printers with decreasing dot size and increasing precision. These and other aspects and advantages of the invention will be better understood by reference to the following detailed description taken in conjunction with the accompanying drawings.

BRIEF DESCRIPTION OF THE DRAWINGS

FIG. 1 is a diagram of inkjet printing dots of a first size having a given overlap;

FIG. 2 is a diagram of inkjet printing dots of a second size smaller than the first size and having a same percentage of overlap;

FIG. 4 is a block diagram of a carriage drive system;

DESCRIPTION OF SPECIFIC EMBODIMENTS

Figure 3:
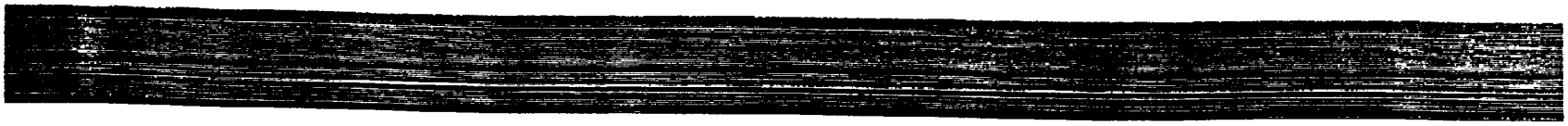
FIG. 3 is a copy of an image which exhibits banding due to vibrations of a carriage relative to a media sheet within an inkjet printing system.

FIG. 4 shows a carriage drive system 10 having a carriage 20 driven along a carriage path 22 under a drive force 24 generated by a drive motor 26. As the carriage is driven back and forth in directions 58, 60, the carriage position along the carriage path 22 is monitored by a position detector 30 (e.g., linear encoder). The position detector 30 provides feedback of the carriage position for accurately controlling the movement of the carriage 20 relative to a media 32. The carriage carries a device 34 which acts upon the media 32.

In an inkjet printing apparatus embodiment, the device 34 is one or more inkjet pens. The inkjet pen includes a pen body with an internal reservoir and a printhead. The printhead includes an array of printing elements. For a thermal inkjet printhead, each printing element includes a nozzle chamber, a firing resistor and a nozzle opening. Ink flow from the reservoir into the nozzle chambers, then is heated by activation of the firing resistor. A vapor bubble forms in the nozzle chamber which forces an ink drop to be ejected through the nozzle opening on the media. Precise control of the ink drop ejection and the relative position of the inkjet pen and media enable formation of characters, symbols and images on the media.

In a document scanning apparatus embodiment the device 34 carried by the carriage 20 is one or more optical sensors and the media is a document having markings (e.g., characters, symbols or images). As the carriage moves relative to the document, the optical sensor detects the markings on the document. Precise control of the optical sensor position relative to the document enables an electronic image of the document to be generated. In character recognition systems, software is included which recognizes given marking patterns as given alphanumeric characters.

Figure 5:
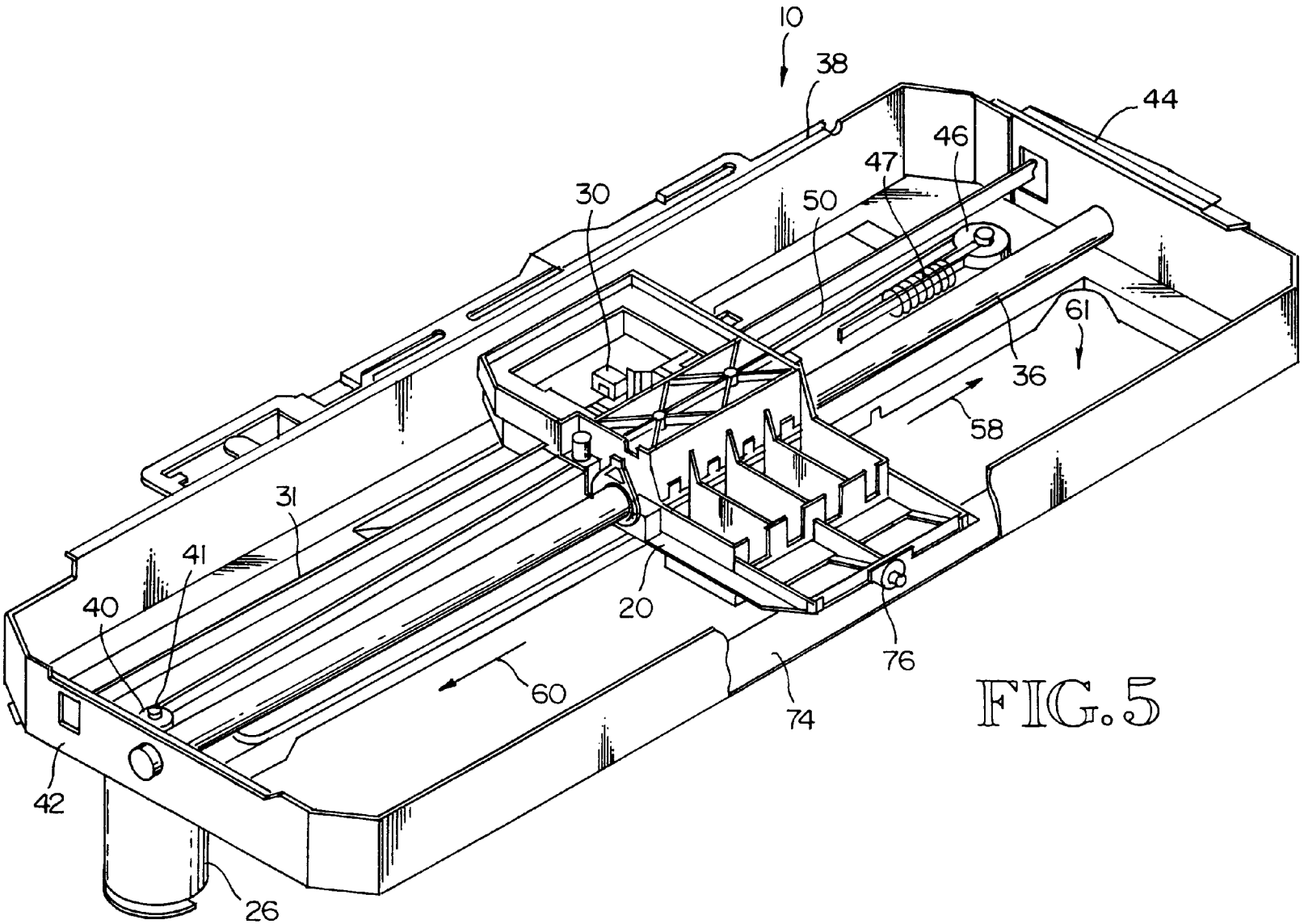
FIG. 5 is a perspective view of a carriage drive system for an inkjet printing system according to an embodiment of this invention.
Figure 6:
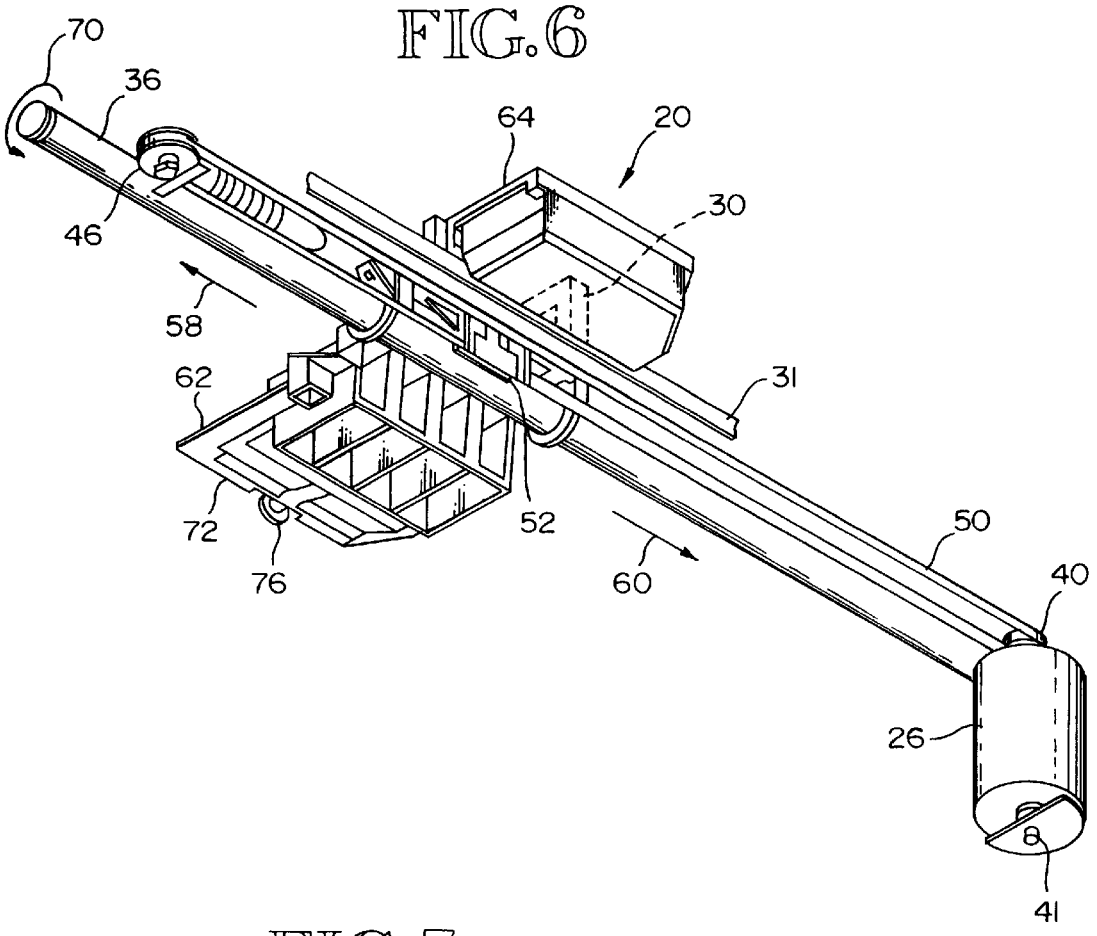
FIG. 6 is a perspective view of a portion of the carriage drive system of FIG. 5.

FIGS. 5 and 6 show a perspective view of the carriage drive system 10 according to an embodiment of this invention. The carriage 20 is driven along a carriage rod 36. The carriage rod is mounted to a carriage plate 38. The carriage plate 38 serves as a frame for the carriage drive system 10. The drive motor 26 is mounted to the carriage plate 38. The drive motor 26 includes a rotating shaft 41 upon which a pulley 40 is mounted. The motor 26 and pulley 40 are located toward one end 42 of the drive plate. Toward an opposite end 44 a spring-loaded pulley 46 is mounted. A drive belt 50 runs along the pulleys 40, 46 and is held in tension by the idler spring 47 which spring-loads the pulley 46. The drive belt 50 is connected to the carriage 20 through a pivotal connection 52 (see FIGS. 6–11) so as to couple the drive force generated by the motor 26 to the carriage 20. As the motor 26 rotates its shaft, the drive belt runs along the pulleys 40, 46 causing the carriage 20 to move first in one direction 58, then back in the opposite direction 60 along the carriage rod 36. The carriage plate 38 includes an opening 61 which exposes a portion of the carriage 20 to an underlying media. Such carriage portion carries the device 34 (e.g., inkjet pen or document scanner sensor).

The carriage 20 carries a device 34 (see FIG. 4) for printing or scanning a media. The carriage 20 also carries a linear encoder module 30. A linear encoder strip 31 is fixed relative to the carriage plate 38. The strip 31 includes evenly spaced markings. The linear encoder module 30 includes an optical sensor which detects and counts such markings so as to track the location of the carriage 20 relative to the strip 31. Because the strip 31 and carriage rod 36 are fixed relative to the carriage plate 38, the linear encoder module 30 is able to detect the carriage position relative to the linear encoder strip 31, the carriage plate 38 and the carriage rod 36.

Figure 7:
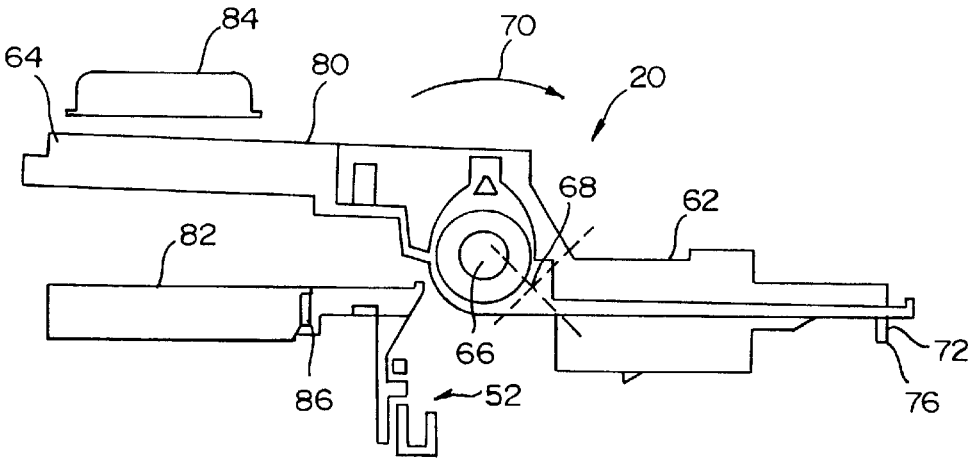
FIG. 7 is an exploded planar view of the carriage of FIGS. 5 and 6.

FIG. 7 shows an exploded view of the carriage 20 for an inkjet printing embodiment. The carriage is formed by a first member 80, a second member 82 and a cap member 84. The second member 82 and cap member 84 are attached to the first member 80. The first member 80 includes a first portion 62 for carrying an inkjet pen device 34 (see FIG. 4) and a second portion 64 for receiving the second member 82 and cap member 84. The second member 82 houses the linear encoder module and other electronic circuitry (e.g., print control circuitry, print memory). The second member 82 includes a slot 86 through which the linear encoder strip 31 runs during movement of the carriage 20. The second member 82 also includes the pivotal connection 52 which couples the carriage 20 to the drive belt 50. The cap member 84 covers the linear encoder module 30 and electronic circuitry.

The first member 80 includes an opening 66 which extends through a center area and receives the carriage rod 36. With the pen(s) loaded and the electronic circuitry mounted, the center of gravity 68 of the carriage 20 is located slightly forward and down of the opening 66 center point toward the first portion 62. Thus, as the carriage 20 moves along the carriage rod 36 there is a moment arm 70 about the carriage rod 36 which biases a distal end 72 of the carriage 20 toward a first surface 74 of the carriage plate 38. A roller 76 is mounted to the carriage 20 first portion 62 toward the distal end 72. Under the gravitational force of the moment arm 70, the roller 76 resides in contact with the carriage plate first surface 74. As the carriage 20 moves along the carriage rod 36, the roller 76 runs along the first surface 74.

Carriage—Drive Belt Connection

Figure 8:
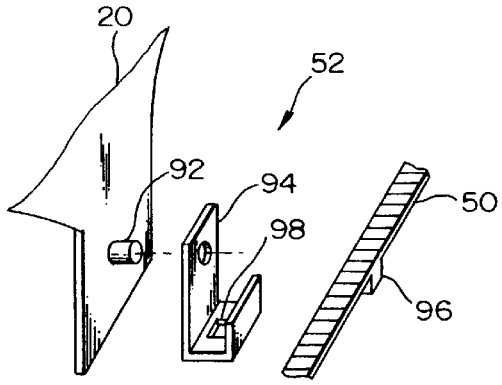
FIG. 8 is an exploded view of the pivot connection between the drive belt and carriage of FIGS. 5–7.

A pivotal connection 52 is mounted to the carriage 20 as shown in FIGS. 6–8. Referring to FIG. 8, the connection 52 includes an axle 92 and a frame 94. The axle 92 is fixed to the carriage 20. The frame 94 rotates about the axle 92. The drive belt 50 is fastened, anchored or otherwise fixedly positioned relative to the frame 94. In one embodiment the drive belt 50 includes a protrusion 96 which mates into an opening 98 in the frame 94. Such protrusion 96 fixes the drive belt 50 relative to the frame 94. As the drive motor 26 rotates, the motor shaft 41 moves the drive belt 50 along the pulleys 40, 46. The movement of the drive belt 50 exerts a drive force on the carriage 20 moving the carriage 20 along a carriage path defined by the carriage rod 36. The drive force originates at the drive motor 26 and is translated to the carriage 20 through the drive shaft 41, drive belt 50 and pivotal connection 52.

Figure 9:
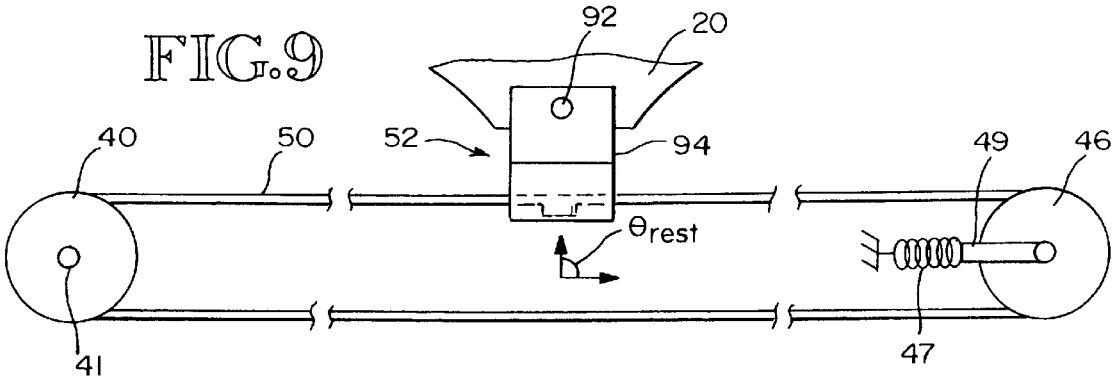
FIG. 9 is a diagram of the pivot connection of FIG. 8 while the carriage of FIG. 7 is at rest.

Referring to FIG. 9, while the carriage 20 is stationary, the frame 94 of the pivotal connection 52 is at a known angle $\theta_{rest}$ relative to the length of the drive belt 50. Such angle may vary for differing embodiments. Such angle also may change as a result of the angle occurring when the carriage 20 last stopped. FIG. 9 shows the carriage 20 at a rest position where the known angle $\theta_{rest}$ is 90 degrees. As the carriage 20 moves, the carriage exerts a side load onto the drive shaft 41 and drive motor 26.

Figure 10:
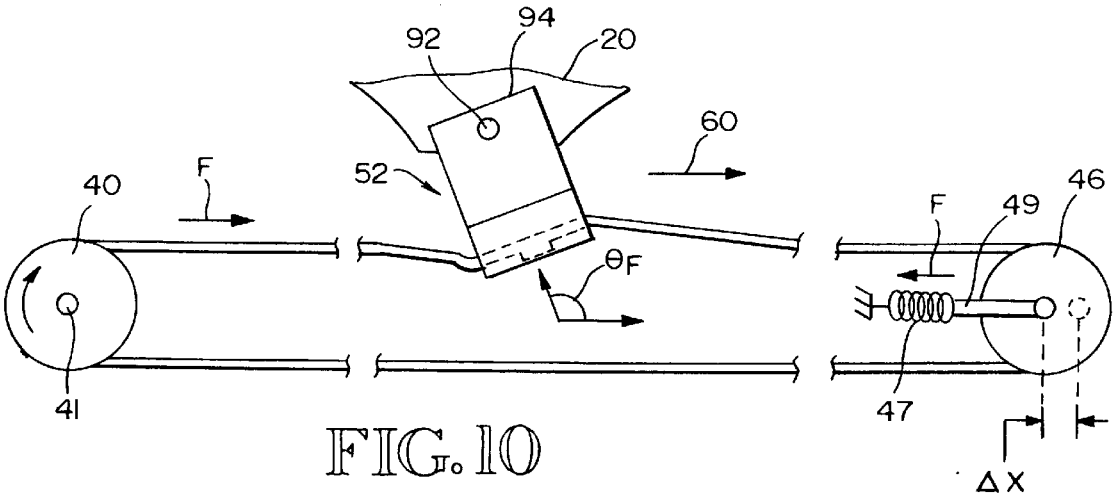
FIG. 10 is a diagram of the pivot connection of FIG. 8 while the carriage of FIG. 7 is in accelerated motion.

FIG. 10 shows the carriage 20 being accelerated in a direction 60 in response to a drive force F. The acceleration causes the drive belt 50 to lead and the pivot frame 94 to offset so that the carriage lags at the pivot connection 52. Such lag appears as an angular offset at the pivot connection 52. Specifically, the frame 94 rotates about the axle 92 to be offset at an offset angle $\theta_F$ relative to the carriage path. The drive force F also acts on the spring-loaded pulley 46 pulling the spring-loaded pulley 46 toward the drive motor pulley 40 by an incremental distance $\Delta x$. This increases the tension in the drive belt 50. The increase in the drive belt tension is determined by the drive force F. In a preferred embodiment, the increased tension is absorbed by the pulley 46 or a post 49 connecting the spring 47 to the pulley 46, without expanding the spring 47 so as to simplify the system dynamics. In particular there is one spring constant for the pulley 46, spring 47, and post 49 for a range of belt tension in which the spring does not expand, and another for a range of higher belt tension in which the spring does expand.

During movement of the carriage 20 there is a side load exerted through the drive belt 50 onto the drive shaft 41 and drive motor 26. For a given acceleration there is a given side load exerted on the drive shaft 41 and drive motor 26. To accelerate the motion of the carriage 20, the motor accelerates the rotation of the timing belt 50. Acceleration of the timing belt 50 causes the pivotal connection 52 to rotate. This shortens the effective length of the belt 50, which in turn compresses the idler spring 47, thereby increasing the belt tension.

Figure 11:
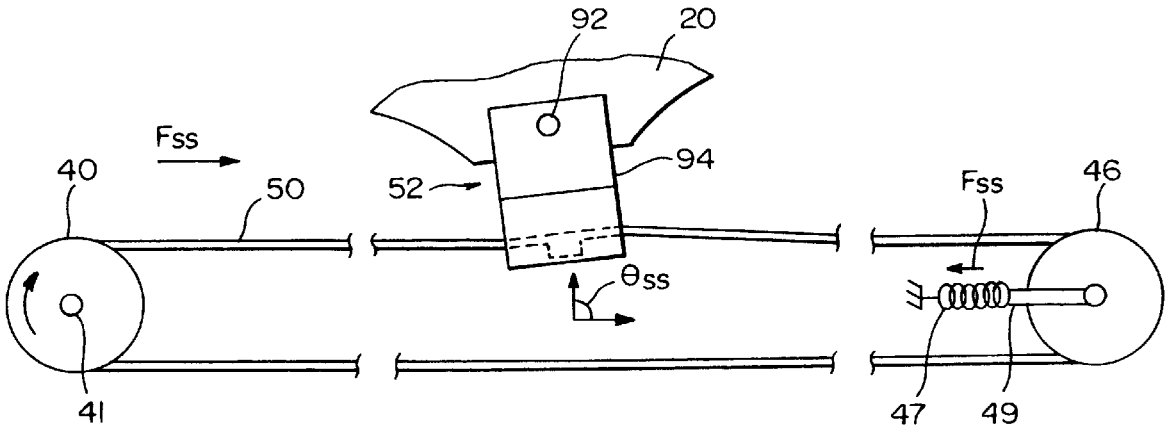
FIG. 11 is a diagram of the pivot connection of FIG. 8 while the carriage of FIG. 7 is in constant velocity motion.

Once the carriage 20 accelerates to a desired velocity, the motor 26 rotates the shaft 41 at a constant velocity. In turn the drive belt 50 moves at a constant velocity. The effect is that the force F decreases (to a value $F_{ss}$ needed to overcome friction). Referring to FIG. 11, the reduced force allows the pivot connection 52 to rotate back toward its rest position into a steady state position $\theta_{ss}$ where $\theta_{ss}$, is at the same angle as the rest position angle $\theta_{rest}$ or is slightly offset from such angle. Of significance is that the belt tension during this steady state motion is less than a corresponding belt tension in a system having a rigid connection between the drive belt 50 and the carriage 20 or in a system having a non-rotating connection 52 (as shown in FIGS. 8–10).

An advantage of the pivotal connection 52 is that belt tension is increased only when needed. During slewing the belt tension is low. During acceleration the belt tension is increased. Larger side loads increase friction on the motor bearings, which in turn decrease the motor's thermal margin. The rest and steady state periods of substantially less side load allow the motor bearings to wear longer. The larger side loads also exert a bending moment on the shaft 41 that can fatigue the windings and solders joints of a drive motor 26. The rest and steady state periods of substantially less side load allow for periods of a differentially smaller bending moment. Thus, the life of the motor windings and solder joints are prolonged.

The pivot connection 52 also serves to isolate the carriage 20 from high frequency vibrations occurring in the drive belt 50. As the motor 26 generates the drive force 24 to move the carriage 20 along the carriage rod 36, the drive force is transmitted to the carriage through the pivot connection 52. For motion in the direction 58, the pivot connection 52 is biased by the drive force to rotate in one direction. For motion in the direction 60 pivot connection 52 is biased by the drive force to rotate in another direction. As vibrations occur the belt tension jitters causing the angle of the pivot connection 52 to correspondingly jitter so as to absorb the vibrations.

Typically a constant drive force is applied during movement of the carriage in one direction. The force then diminishes and reverses to move the carriage in the other direction. The back and forth motion of the carriage occurs at a first frequency which defines the frequency of change for the drive force. Vibrations are coupled onto the drive belt 50 inadvertently, however. These vibrations generally occur over a range of frequencies extending much higher than the first frequency. As described in the background section, the vibrations can have adverse impacts on the print quality of a printing system or the scan quality of a scanning system. The pivot connection 52 serves as a low pass filter which absorbs the high frequency vibrations and passes the low frequency vibrations (e.g., the drive force first frequency).

Low frequency vibrations which are not filtered out by the pivot connection 52 are compensated for by the linear encoder module 30. The linear encoder serves to detect carriage position. Carriage position is monitored so that ink dots can be accurately placed on a media sheet or markings can be accurately detected. By mounting the linear encoder onto the carriage, the linear encoder detects carriage position independently of the motor shaft 41 rotation. As a result, vibrations in the motor shaft are not coupled into the position detection scheme. Thus, the linear encoder is able to detect the carriage position even in the presence of carriage vibrations. Such vibrations move the linear encoder module 30 relative to the linear encoder strip 31. Thus carriage position is detected during portion of a vibration period. More specifically though, low frequency vibrations occurring at a frequency less than the sampling rate of the linear encoder and of an amplitude detectable by the linear encoder are detected by the linear encoder. Such vibrations are in effect compensated for by adjusting the timing of ink drop ejections or optical sensor scanning to accurately perform the printing or scanning function.

Thus, the linear encoder 30 enables low frequency vibration compensation, while the pivot connection provides high frequency vibration isolation. Such high frequency isolation is for vibration force components occurring along the axis of the scan path. Vibration force components occurring along axes orthogonal to the scan path 22 are not problematic due to the stiffness of the carriage and a carriage rod along which the carriage moves. Vibrations in such orthogonal directions would tend to force the carriage in a direction perpendicular to the carriage rod 36. There is insufficient play in the connection between carriage 20 and carriage rod 36 for such vibration components to adversely impact printing.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A carriage scanning system, comprising:

a carriage which moves along a carriage path;

a drive motor which generates a drive force; and a drive belt coupled to the drive motor and indirectly coupled to the carriage, the drive belt coupling the drive force to the carriage to cause the carriage to move along the carriage path; and a pivoting coupler which connects to the carriage and to the drive belt, the coupler indirectly coupling the drive belt to the carriage, the coupler pivoting relative to the carriage and being fixed relative to the drive belt along a length of the drive belt, the coupler displacing the drive belt during a pivoting action of the coupler relative to the carriage, wherein the carriage exerts a side load on the motor through the coupler and the drive belt during movement of the carriage along the carriage path in response to the drive force, and wherein the pivoting of the coupler relative to the carriage reduces the carriage side load on the motor during constant velocity motion of the carriage.

2. The system of claim 1, in which the motor includes a motor shaft, the system further comprising a first pulley coupled to the motor shaft and a second pulley anchored by an idler spring, the drive belt moving in response to the drive force relative to the first and second pulleys, and wherein during acceleration of the carriage in response to the drive force the coupler pivots relative to the carriage.

3. The system of claim 1, in which the coupler comprises means for isolating the carriage from vibrations occurring within the drive belt, said isolating means comprising means for pivoting the coupler relative to the carriage, while maintaining the coupler fixed relative to the drive belt.

4. The system of claim 1, in which the coupler is not part of the drive belt.

5. The system of claim 1, in which the drive belt comprises a structure for engaging the coupler.

6. The system of claim 1, in which the drive belt comprises a structure for detachably engaging the coupler.

7. An inkjet printing system for printing to a media sheet, comprising:

a frame;

a carriage rod mounted to the frame;

a carriage which moves along the carriage rod;

an inkjet pen mounted within the carriage for ejecting ink drops during movement of the carriage along the carriage rod;

a coupler pivotally mounted to the carriage;

a drive motor which generates a drive force; and a drive belt coupled to the drive motor and indirectly coupled to the carriage through the pivotally mounted coupler, the drive belt coupling the drive force to the carriage to cause the carriage to move along a carriage path;

wherein the coupler connects the carriage to the drive belt, the coupler pivoting relative to the carriage and being fixed relative to the drive belt along a length of the drive belt, the coupler displacing the drive belt during said pivoting of the coupler, the pivoting of the coupler isolating the carriage from vibrations occurring within the drive belt, wherein the carriage exerts a side load on the motor through the coupler and the drive belt during movement of the carriage alone the carriage path in response to the drive force, and wherein the pivoting of the coupler relative to the carriage reduces the carriage side load on the motor during constant velocity motion of the carriage.

8. The printing system of claim 7, in which the motor includes a motor shaft, the system further comprising a first pulley coupled to the motor shaft and a second pulley anchored by an idler spring, the drive belt moving in response to the drive force relative to the first and second pulleys, and wherein during acceleration of the carriage in response to the drive force the coupler pivots relative to the carriage.

9. The scanning system of claim 3, in which the motor includes a motor shaft, the system further comprising a first pulley coupled to the motor shaft and a second pulley anchored by an idler spring, the drive belt moving in response to the drive force relative to the first and second pulleys, and wherein during acceleration of the carriage in response to the drive force the coupler pivots relative to the carriage.

10. The system of claim 7, in which the coupler comprises means for detachably connecting to the drive belt.

11. A document scanning system, comprising:

a frame;

a carriage rod mounted to the frame;

a carriage which moves along the carriage rod;

an optical sensor mounted to the carriage for scanning a document during movement of the carriage along the carriage rod;

a coupler pivotally mounted to the carriage;

a drive motor which generates a drive force; and a drive belt coupled to the drive motor and indirectly coupled to the carriage through the coupler, the drive belt coupling the drive force to the carriage to cause the carriage to move along a carriage path; and wherein the coupler connects the carriage to the drive belt, the coupler pivoting relative to the carriage and being fixed relative to the drive belt along a length of the drive belt, the coupler displacing the drive belt during said pivoting of the coupler, the pivoting of the coupler isolating the carriage from vibrations occurring within the drive belt, wherein the carriage exerts a side load on the motor through the coupler and the drive belt during movement of the carriage along the carriage path in response to the drive force, and wherein the pivoting of the coupler relative to the carriage reduces the carriage side load on the motor during constant velocity motion of the carriage.

12. The system of claim 11, in which the coupler comprises means for detachably connecting to the drive belt.

13. A carriage scanning system, comprising:

a drive motor which generates a drive force;

a drive belt coupled to the drive motor and receiving the drive force, the drive belt having a first tension in the absence of a drive force;

a carriage indirectly coupled to the drive belt, the carriage moving along a carriage path and exerting a side load on the motor during such moving along the carriage path, wherein the drive belt couples the drive force to the carriage to cause the carriage to move along the carriage path; and a coupler pivotally mounted to the carriage and detachably connected to the drive belt, the coupler connecting the carriage to the drive belt, the coupler pivoting relative to the carriage and being fixed relative to the drive belt along a length of the drive belt, the coupler comprising means for reducing a side load acting on the motor attributable to the carriage during constant velocity motion of the carriage, and means for pivoting the carriage relative to the drive belt during acceleration of the carriage along the carriage path, the acceleration resulting from the drive force acting on the carriage.

14. The system of claim 13, in which the motor includes a motor shaft, the system further comprising a first pulley coupled to the motor shaft and a second pulley anchored by an idler spring, the drive belt moving in response to the drive force relative to the first and second pulleys.

15. The system of claim 13, in which the coupler comprises means for isolating the carriage from vibrations occurring within the drive belt, said isolating means comprising means for pivoting the coupler relative to the carriage, while maintaining the coupler fixed relative to the drive belt.

* * * * *

UNITED STATES PATENT AND TRADEMARK OFFICE

CERTIFICATE OF CORRECTION

PATENT NO. : 5,964,542
DATED : October 12, 1999
INVENTOR(S) : Ruhe et al.

It is certified that error appears in the above-identified patent and that said Letters Patent is hereby corrected as shown below:

Column 2, (line 65), after "in" insert --a--.

Column 6, (line 7), delete "position $\theta_{ss}$ where $\theta_{ss}$, is" and insert therefor --position $\theta_{ss}$, where $\theta_{ss}$ is--.

Column 8, (line 21), delete "alone" and insert therefor --along--.

Column 8, (line 34), delete "claim 3" and insert therefor --claim 7--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*